US006484005B2

(12) United States Patent
Shinoda

(10) Patent No.: US 6,484,005 B2
(45) Date of Patent: Nov. 19, 2002

(54) IMAGE FORMING APPARATUS

(75) Inventor: Keisuke Shinoda, Tokyo (JP)

(73) Assignee: NEC Corp. (JP)

( * ) Notice: Subject to any disclaimer, the term of this patent is extended or adjusted under 35 U.S.C. 154(b) by 0 days.

(21) Appl. No.: 09/778,559

(22) Filed: Feb. 7, 2001

(65) Prior Publication Data

US 2001/0017996 A1 Aug. 30, 2001

(30) Foreign Application Priority Data

Feb. 24, 2000 (JP) ..... 2000-047357

(51) Int. Cl.[7] ..... G03G 15/10
(52) U.S. Cl. ..... 399/249
(58) Field of Search ..... 399/98, 237, 239, 399/240, 249, 348

(56) References Cited

U.S. PATENT DOCUMENTS 3,955,533 A * 5/1976 Smith et al. ..... 399/249
4,353,639 A * 10/1982 Moraw et al. ..... 399/249
5,300,990 A * 4/1994 Thompson ..... 399/240
5,481,341 A * 1/1996 Sypula et al. ..... 399/239
5,978,630 A * 11/1999 Chang et al. ..... 399/249
6,243,553 B1 * 6/2001 Lee et al. ..... 399/249

FOREIGN PATENT DOCUMENTS

JP 05-289528 * 11/1993
JP 07-175330 * 7/1995

* cited by examiner

*Primary Examiner*—Sandra Brase
(74) *Attorney, Agent, or Firm*—Dickstein, Shapiro, Morin & Oshinsky LLP

(57) ABSTRACT

An image forming apparatus having a spacer that maintains a given clearance between a cylindrical outer peripheral surface of the squeezing roller and a cylindrical outer peripheral surface of the cleaning roller.

9 Claims, 3 Drawing Sheets

IMAGE FORMING APPARATUS

BACKGROUND OF THE INVENTION

1. Field of the Invention

The present invention relates generally to an image forming apparatus. More particularly, the invention relates to an image forming apparatus having a squeezing roller for applying a pressure in order to remove a solvent in a liquid toner from an image developed on a photoconductive drum which is formed with a photoconductor on a surface thereof.

2. Description of the Related Art

Conventionally, as shown in FIG. 5, in an image forming apparatus having a squeezing roller 17 for removing a solvent in a liquid toner from an image developed on a photoconductor belt 15, it has been known that a load distribution in a roller axis direction between a squeezing roller 17 and a back-up roller 18 is required to achieve a uniform drying ratio over the entire image. For this purpose, a surface elastic body of the squeezing roller 17 is formed into a crown shape.

However, in the conventional image forming apparatus constructed as set forth above, in order to clean toner particles which are mechanically or electrically deposited on the squeezing roller 17, a cleaning roller 16 that electrically removes the toner particles on the squeezing roller 17 is provided at an opposite position to the contacting surface of the photoconductor belt 15. Since the surface elastic body of the squeezing roller 17 is formed into a crown shape, field gap in the axial direction of the squeezing roller tends to be non-uniform.

In the conventional image forming apparatus, the tip end portion of a cleaning blade (not shown) is positioned so a to clean the toner particles electrically deposited on the cylindrical outer periphery of the cleaning roller 16. The cleaning blade contacts stirring hair of a brush roller (not shown) so as to remove toner particles firmly stacked on the tip end portion thereof. The tip end position of the cleaning blade becomes significantly worn due to the rubbing of the tip end portion of the cleaning blade by the brush roller.

SUMMARY OF THE INVENTION

The present invention in the conventional image forming apparatus as set forth above. Therefore, it is an object of the present invention to provide an image forming apparatus which compensates for the unevenness of the field gap in an axial direction of a squeezing roller, can efficiently clean the squeezing roller, and can prevent the wearing of a tip end portion of a cleaning blade due to rubbing so as to provide a longer life.

In order to accomplish the above-mentioned and other objects, an image forming apparatus, in accordance with one aspect of the present invention, comprises:

a solvent-based liquid toner;

a squeezing roller applying a predetermined pressure on the liquid toner on a photoconductor belt for removing the solvent in the liquid toner from an image developed on the photoconductor belt;

a cleaning roller arranged at a position opposing to the squeezing roller for removing a toner particle depositing on a cylindrical outer peripheral surface of the squeezing roller by application of a voltage; and a spacer maintaining a given clearance between a cylindrical outer peripheral surface of the squeezing roller and a cylindrical outer peripheral surface of the cleaning roller.

With the invention set forth above, since the clearance between the cylindrical outer peripheral surface of the squeezing roller and the cylindrical outer peripheral surface of the cleaning roller is maintained, at a set distance by the spacer a field gap in the axial direction of the squeezing roller will not become uneven, and therefore, permit efficient cleaning of the squeezing roller.

In the preferred construction, the squeezing roller may include a cylindrical bare pipe; an elastic body attached on a cylindrical outer peripheral surface of the bare pipe; and a shaft extending through the bare pipe. The bare pipe and the shaft are preferably connected at two points along a substantially central portion along the axial direction of the squeezing roller.

In the preferred construction, the pressure between the photoconductor belt and the squeezing roller in the axial direction of the squeezing roller can be made uniform, and the clearance between the squeezing roller and the cleaning roller can be constantly maintained without being influenced by a deflection of the squeezing roller due to high load placed thereon.

Preferably, the spacer is a disc provided at an end portion of the cleaning roller, and rotates integrally therewith.

Accordingly, with this simple construction, the clearance between the cylindrical outer peripheral surface of the squeezing roller and the cylindrical outer peripheral surface of the cleaning roller can be maintained.

Also, the disc may be attached on the cylindrical outer peripheral surface of the squeezing roller, and may contact the cylindrical outer peripheral surface of the bare pipe of the squeezing roller. The disc may also be fixed to a rotary shaft of the cleaning roller.

The disc may contact with the cylindrical outer peripheral surface of the bare pipe of the squeezing roller.

The disc may be fixed to a rotary shaft of the cleaning roller.

By the construction set forth above, depending upon the size of the disc as the spacer, the clearance between the cleaning roller and the squeezing roller can be adjusted.

In another preferred construction, an engaging dimension between an external diameter of the shaft of the cleaning roller and an internal diameter of a bearing is set such that the radial thickness portion of the disc defines the radial thickness portion of the disc defines the clearance between the squeezing roller and the cleaning roller and the clearance can be constantly maintained.

Accordingly, since the clearance between the squeezing roller and the cleaning roller can be constantly maintained by defining only the dimension of the thickness portion of the disc as the spacer, manufacturing of the image forming apparatus can be easily facilitated.

The image forming apparatus may further comprise a cleaning blade having a tip end thereof in contact with the outer peripheral surface of the cleaning roller for removing toner particles electrically deposited on the outer peripheral surface of the cleaning roller, and a liquid toner storage portion for storing the liquid toner defined around the tip end portion of the cleaning blade.

Accordingly, with the stored liquid toner, the toner particles stacked on the tip end portion of the cleaning blade can be removed without contact between the ends of the brush of the brush roller and the tip end portion of the cleaning blade.

The liquid toner storage portion may be adjustable so as to vary the liquid toner storage amount.

By this, the cleaning effect of the tip end portion of the cleaning blade can be adjusted.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. Additionally, well-known structures are not shown in detail in order to avoid unnecessary obscurity of the present invention.

Figure 1:
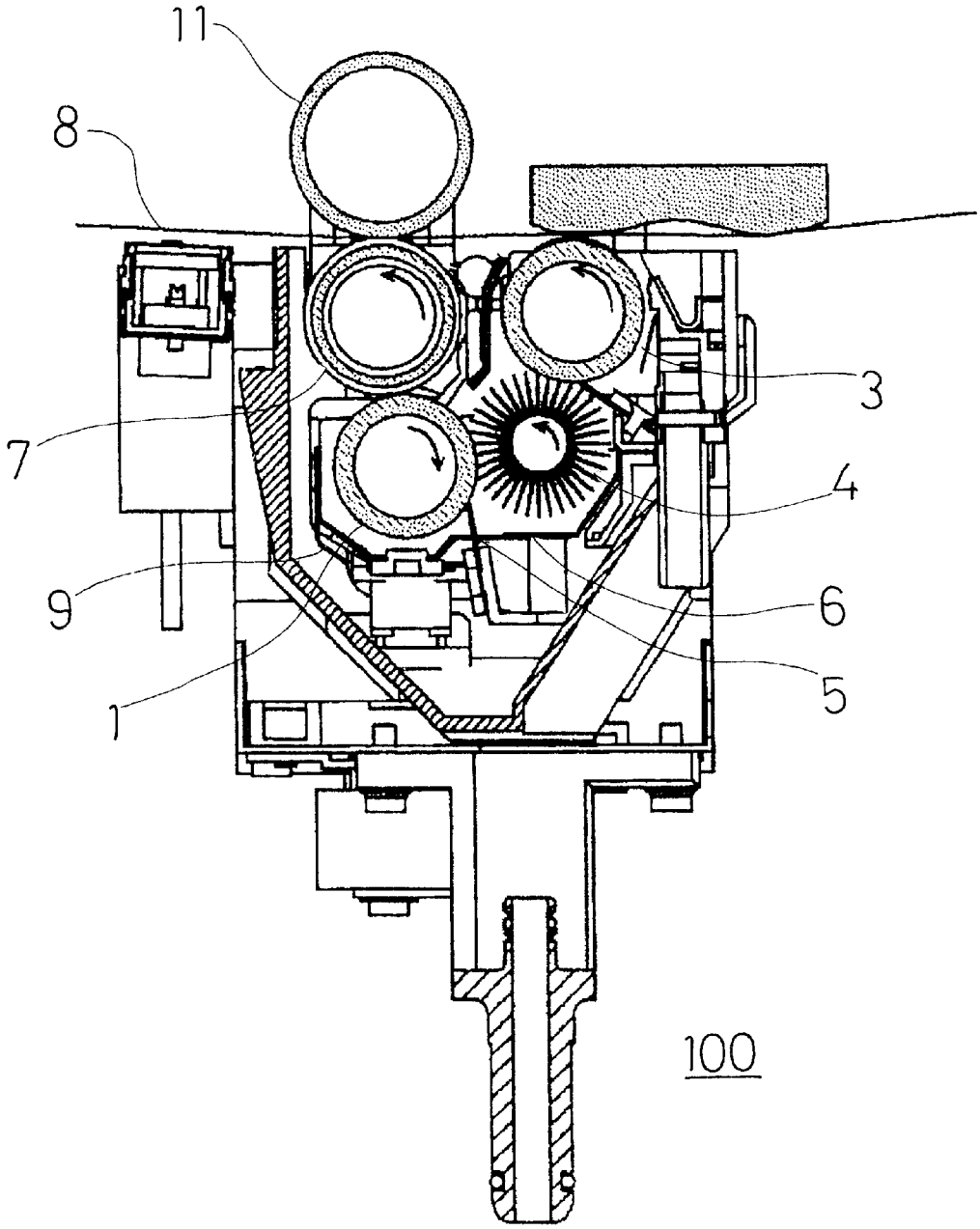
FIG. 1 is an illustration showing an overall construction of one embodiment of an image forming apparatus according to the present invention.

FIG. 1 shows one embodiment of an image forming apparatus according to the present invention. The image forming apparatus is an image forming apparatus employing a liquid toner and is constructed with a photoconductor belt 8, a developer roller 3, a squeezing roller 7, a back-up roller 11, a cleaning roller 1, a brush roller 4, a cleaning blade 5 and a reservoir 6 and a reservoir 6.

All of components other than squeezing roller 7 are supported by a side place. Also, a components other than the squeezing roller 7 are about the shaft of the developer roller 3 for pendulum swing-like motion. In order to cause pendulum swing, a bias spring (no shown) is arranged on a buttom surface of the side plate.

On the side plate, the brush roller 4 is ratably mounted at a given penetration amount to the cleaning roller 1 in order to stir the liquid toner and remove the toner particle stacking of on a tip end portion of the cleaning blade 5 without contact with the cleaning blade.

The cleaning roller 1 is inserted in the side plate and is supported rotatably.

cleaning blade 5 is provided for cleaning the toner particle electrically deposited on the cylindrical outer peripheral surface of the cleaning roller 1. To clean the toner particles from the cleaning roller the tip portion of the cleaning lade 5 contacts the outer peripheral surface of the cleaning roller 1. It should be noted that the cleaning blade 5 and the brush roller 4 are arranged so as not to contact with each other.

The reservoir 6 is surrounded by the cleaning roller 1, the brush roller 4 and the cleaning blade 5. The inside of the reservoir 5 serves as a liquid toner storage portion for storing a liquid toner. In the reservoir 6, a support 9 for adjustment the filling height of the liquid toner stored therein, is secured at variable positions.

Figure 2:
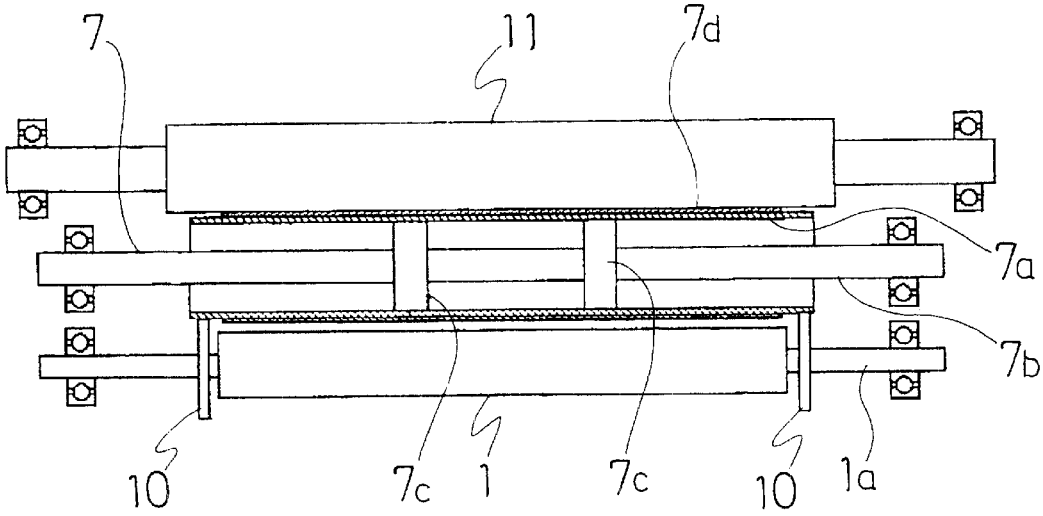
FIG. 2 is a partial section showing one example of a construction of a squeezing roller and cleaning roller of the image form apparatus of FIG. 1.

The squeezing roller 7 is directly driven to contact with the photo conductor belt 8 under pressure. At the time of contact, the pressure contact load becomes about 30 kgf so as to cause mechanical deflection in the squeezing roller 7. The squeezing roller 7 includes a cylindrical bare pipe 7*a,* an elastic body 7*d* attached on the cylindrical outer peripheral surface of the bare pipe 7*a* and a shaft 7*a* extending through the center of the bare pipe 7*a,* as shown in FIG. 2. The bare 7*a* and the shaft 7*a* are connected at two connecting portions 7*c* at substantially central portion along the axial direction of the squeezing roller 7. By this, mechanical deflection caused with the photoconductor belt 8 under pressure can be minimized.

As shown in FIG. 2, on a rotary shaft la of the cleaning roller 1, a spacer disc 10 having a diameter greater than that of the cleaning roller 1 is provided. The spacer disc 10 contacts with the cylindrical outer peripheral surface of the bare pipe 7*a* of the squeezing roller 7 under pressure and rotates integrally with the cleaning roller 1. Thus, a clearance between the squeezing roller 7 and the cleaning roller 1 can be constantly maintained.

Figure 3:
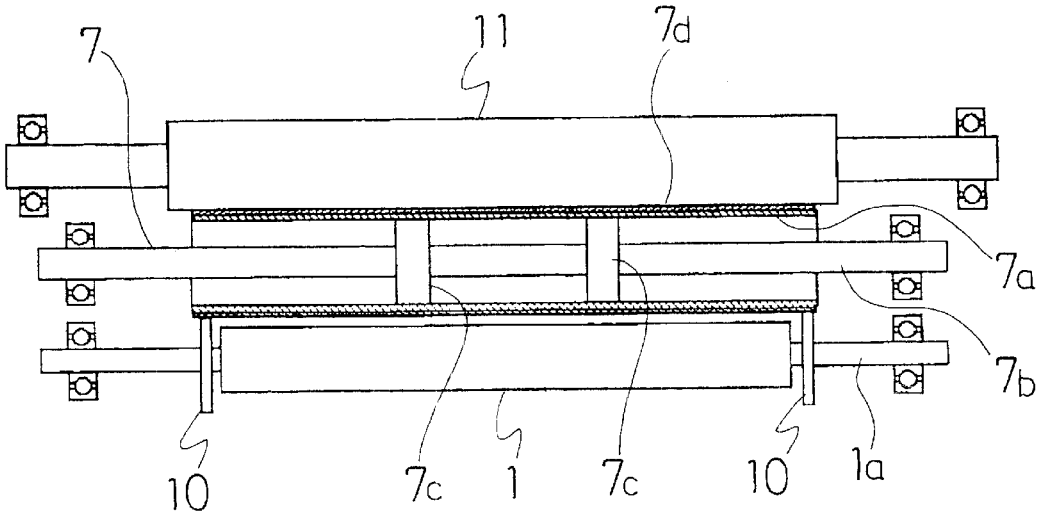
FIG. 3 is a partial section showing another example of a construction of a squeezing roller and cleaning roller of the image forming apparatus of FIG. 1.
Figure 4:
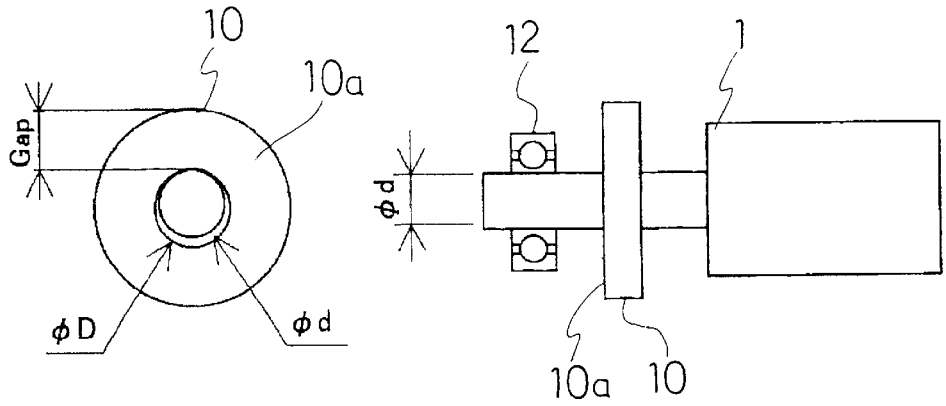
FIG. 4 is a general illustration for explaining a relationship between a spacer disc and a bearing of the image forming apparatus of FIG. 1.
Figure 5:
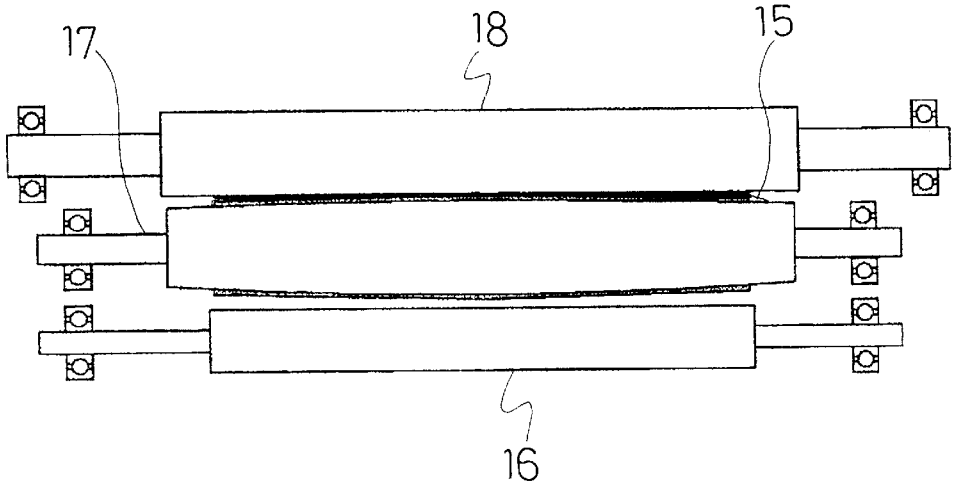
FIG.5 PRIOR ART
FIG. 5 is a general illustration showing one example of the conventional image forming apparatus.

In a alternative embodiment, such as that shown in FIG. 3 the spacer 10 can also be arranged so as to contact the elastic body 7*d* of the squeezing roller 7. By pressure contact of the spacer disc 10 onto the cylindrical outer peripheral surface of the elastic body 7*d* of the squeezing roller 7, it becomes possible to maintain a constant clearance between the squeezing roller 7 and the cleaning roller 1.

Next, operation of the image forming apparatus 100 constructed as set forth above, will be discussed with reference to the drawings.

When the side plate is pivoted about the shaft of the developer roller 3, the cleaning roller 1 is rotated until the spacer discs 10 at both ends of the cleaning roller 1 come into contact with the squeezing roller 7 so as to maintain constant clearance between the cylindrical outer peripheral surface of the squeezing roller 7 and the cylindrical outer peripheral surface of the cleaning roller 1. By this, upon cleaning the toner particles mechanically and electrically deposited on the squeezing roller 7, unevenness of a field gap in the axial direction of the squeezing roller 7 is not created and cleaning of the squeezing roller 7 can be performed efficiently.

After pressure contact with the squeezing roller 7, the spacer disc 10 is rotated by contact friction resistance and thus will not interfere with rotation of the squeezing roller 7 so as to maintain a smooth rotation of the squeezing roller 7.

When image forming operation is performed, and when the solvent of the liquid toner is removed from the image developed on the photoconductor belt 8, a uniform load distribution between the squeezing roller 7 and the back-up roller 11 in an axial direction of the rollers should be established in order to attain a uniform drying ratio over the entire image as set forth above. In the present invention, since the mechanical deflection caused by contacting the squeezing roller 7 with the photoconductor belt 8 under pressure is minimized, uniform load direction in the axial direction of the rollers can be established between the squeezing roller 7 and the back-up roller 11 even when the elastic body of the squeezing roller 7 is not formed into a crown shape.

The support 9 for adjusting filling height of the liquid toner stored in the reservoir 7 is mounted on the side surface of the reservoir 7 and is not secured in position. After moving to desired height position, the support 9 is secured on the side surface of the reservoir.

It should be noted that in the shown embodiment, for making the pressure between the photoconductor belt 8 and the squeezing roller in the axial direction uniform and for constantly maintaining the uniform clearance between the squeezing roller 7 and the cleaning roller 1 without being influenced by deflection of the squeezing roller 7 at high load, the bare pipe 7*a* and the shaft 7*a* of the squeezing roller 7 are preferably connected at two points at a substantially central portion along the axial direction of the squeezing roller 7. Other constructions may be employed as long as a uniform pressure and maintaining of the clearance can be achieved.

Also, while the side place and the components mounted thereon utilize the shaft of the developer roller as the fulcrum of rotating motion, any other shaft may also be used as fulcrum of rotating motion.

Further, the support 9 for adjusting the filling height of the liquid toner to be stored in the reservoir 7 may be separated from the reservoir upon height adjustment and coupled thereto subsequently. The support 9 is used only to the upper limit for sorting the liquid toner in the reservoir.

As set forth above, with the present invention, it is possible to provide an image forming apparatus the pressure between the photoconductor belt and the squeezing roller is maintained uniform in the roller axis direction, the field gap in the axial direction of the squeezing roller will not become uneven, and since the clearance between the squeezing roller and the cleaning roller can be constantly maintained without being influenced by deflection of the squeezing roller due to application of a high load, cleaning of the squeezing roller can be efficiently performed.

Also, with the present invention, an image forming apparatus having a long life can be provided since the toner particles stacked on the tip end portion of the cleaning blade are removed without contacting the ends of the brush of the brush roller with the tip end of the cleaning blade, thereby preventing wearing due to rubbing of the tip and of the cleaning blade.

What is claimed is:

1. An image forming apparatus comprising:

a photoconductor belt having a solvent-based liquid toner image developed thereon;

a squeezing roller applying a predetermined pressure on said liquid toner on said photoconductor belt so as to remove said solvent in said liquid toner image developed on said photoconductor belt;

a cleaning roller arranged at a position opposing said squeezing roller so as to remove toner particles deposited on an outer peripheral surface of said squeezing roller; and a spacer arranged so as to maintain a clearance between said outer peripheral surface of said squeezing roller and an outer peripheral surface of said cleaning roller.

2. The image forming apparatus as set forth in claim 1, wherein said squeezing roller includes:

a cylindrical bare pipe;

an elastic body attached on an outer peripheral surface of said bare pipe; and a shaft extending through said bare pipe, said bare pipe and said shaft being connected at two points at a substantially central portion along an axial direction of said squeezing roller.

3. The image forming apparatus as set forth in claim 2, wherein said spacer is a disc that contacts said outer peripheral surface of said bare pipe.

4. The image forming apparatus as set forth in claim 1, wherein said spacer is a disc provided at an end portion of said cleaning roller and rotating integrally therewith.

5. The image forming apparatus as set forth in claim 4, wherein said disc contacts said outer peripheral surface of said squeezing roller.

6. The image forming apparatus as set forth in claim 4, wherein said disc is fixed to a rotary shaft of said cleaning roller.

7. The image forming apparatus as set forth in claim 6, wherein an engaging dimension between an external diameter of said shaft of said cleaning roller and an internal diameter of a bearing supporting said shaft is set such that a radial thickness portion of said disc defines said clearance between said squeezing roller and said cleaning roller.

8. The image forming apparatus as set forth in claim 1, further comprising:

a cleaning blade arranged so as to have a tip end thereof in contact with said outer peripheral surface of said cleaning roller for removing toner particles deposited thereon; and a liquid toner storage portion for storing said liquid toner defined around said tip end portion of said cleaning blade.

9. The image forming apparatus as set forth in claim 8, wherein said liquid toner storage portion is adjustable so as to vary the amount of liquid toner stored therein.

* * * * *